United States Patent [19]

Ferraro et al.

[11] Patent Number: 4,535,537

[45] Date of Patent: Aug. 20, 1985

[54] DISPOSABLE PLASTIC RAZOR

[75] Inventors: Frank A. Ferraro, Trumbull, Conn.; David S. Byrne, Atlantic Highlands, N.J.

[73] Assignee: Warner-Lambert Company, Morris Plains, N.J.

[21] Appl. No.: 649,643

[22] Filed: Sep. 12, 1984

[51] Int. Cl.[3] ..... B26B 21/14

[52] U.S. Cl. ..... 30/32; 30/41; 30/47; 30/50

[58] Field of Search ..... 30/41, 47, 50, 41.5, 30/32

[56] References Cited

U.S. PATENT DOCUMENTS

| | | | |
|---|---|---|---|
| 2,780,862 | 2/1957 | Grathwohl | 30/32 |
| 2,952,910 | 9/1960 | Meohas | 30/32 X |
| 3,052,023 | 9/1962 | Meohas | 30/41 X |
| 4,016,648 | 4/1977 | Chen et al. | 30/47 |
| 4,069,580 | 1/1978 | Cartwright | 30/50 X |
| 4,403,413 | 9/1983 | Trotta | 30/50 |
| 4,443,939 | 4/1984 | Motta | 30/47 |
| 4,486,952 | 12/1984 | Trotta | 30/47 |
| 4,501,066 | 2/1985 | Sceberras | 30/50 |

*Primary Examiner*—Jimmy C. Peters
*Attorney, Agent, or Firm*—R. S. Strickler

[57] ABSTRACT

A low-cost plastic disposable razor having a plurality of paths for purging the razor of shaving debris.

5 Claims, 5 Drawing Figures

FIG.4
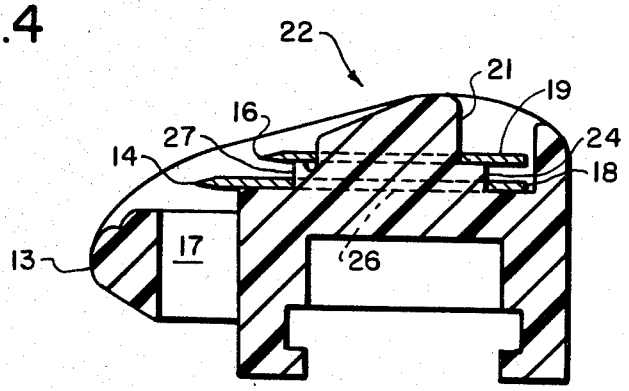
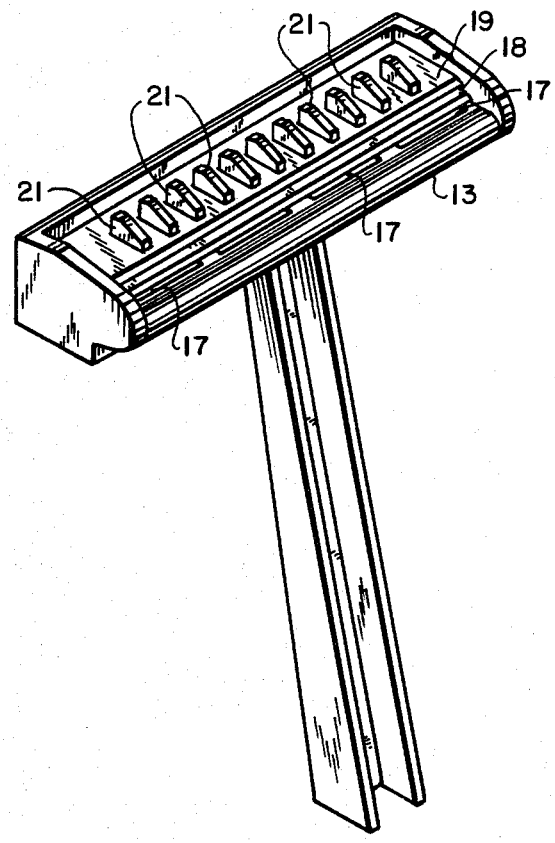
FIG.5

DISPOSABLE PLASTIC RAZOR

BACKGROUND OF THE INVENTION

The present invention relates to razors and relates in particular to disposable razors of all-plastic construction.

The language "all-plastic" is intended to denote all elements of the razor save the metallic blade or blades.

The language "blade" or "blade edge" is intended to include one or more single cutting edge blades.

The transition from conventional shaving appliances to the so-called disposable razors is occurring at an accelerated pace. Emphasis is upon structures that accommodate high-speed, low-cost manufacturing processes that do not sacrifice quality and performance in the end product.

One of the desirable features of all razors is convenience in ridding the razor of shaving debris accumulated during the course of shaving. That is, it is desirable to provide a razor structure that is readily purged of shaving debris by exposure to a stream of domestic water.

A prior art razor which exhibits structure facilitating purging of shaving debris is disclosed and described in U.S. Pat. No. 4,016,648 issued Apr. 12, 1977, to Chen et al. and assigned on the face of the patent to Warner-Lambert Company.

The razor of this disclosure, frequently referred to as a "spacerless razor", shows structure supporting and retaining blades upon posts instead of the usual and customary flat shim-like spacer member.

In the '648 reference, the blade 14 rests upon blade support 62 and is held spaced from the upper blade 16 by posts 7, 8 and 9, extending from a solid cap and projecting downwardly through perforations in the upper blade.

Correspondingly, posts 3, 4, 5 and 6 project upwardly from the blade support 62 and through mating perforations in the lower blade 14.

The posts 3, 4, 5 and 6 bear against upper blade 16 insuring support and the maintenance of blade spacing.

This post structure (in lieu of a flat, sheet-like spacer) provides voids defining a path for washing away shaving debris developing between blades, particularly at the blade cutting edges.

BRIEF DESCRIPTION OF THE INVENTION

The present invention features a razor which affords a plurality of flow paths for facilitating the purging or rinsing of shaving debris.

A special feature of the invention is the provision of at least three general flow paths for rinsing: One path exists at the head or cap of the razor, a second occurs at an elongated slot between a guard bar and blade cutting edges, and a third path leads through space between blades.

A razor embracing certain features of the present invention may comprise a blade support including a face-engaging guard bar, a plurality of posts projecting from said support, a perforated blade having a cutting edge disposed upon said support so that said posts project through mating perforations and said cutting edge projects toward said guard bar, portions of selected posts being deformed to overlay mating portions of said blade to secure the blade to the support, and each post terminating in a predetermined configuration so as to develop collectively a contoured face-engaging surface which in combination with said guard bar and said blade develop optimum blade edge geometry.

Other features and advantages of this invention will become more apparent from an examination of the succeeding specification when read in conjunction with the appended drawings, in which;

BRIEF DESCRIPTION OF THE DRAWINGS

FIG. 4 is a vertical section of FIG. 3 in the plane of the line 4—4; and FIG. 5 shows a razor of the present invention with an integral handle.

DESCRIPTION OF PREFERRED EMBODIMENT

Figure 1:
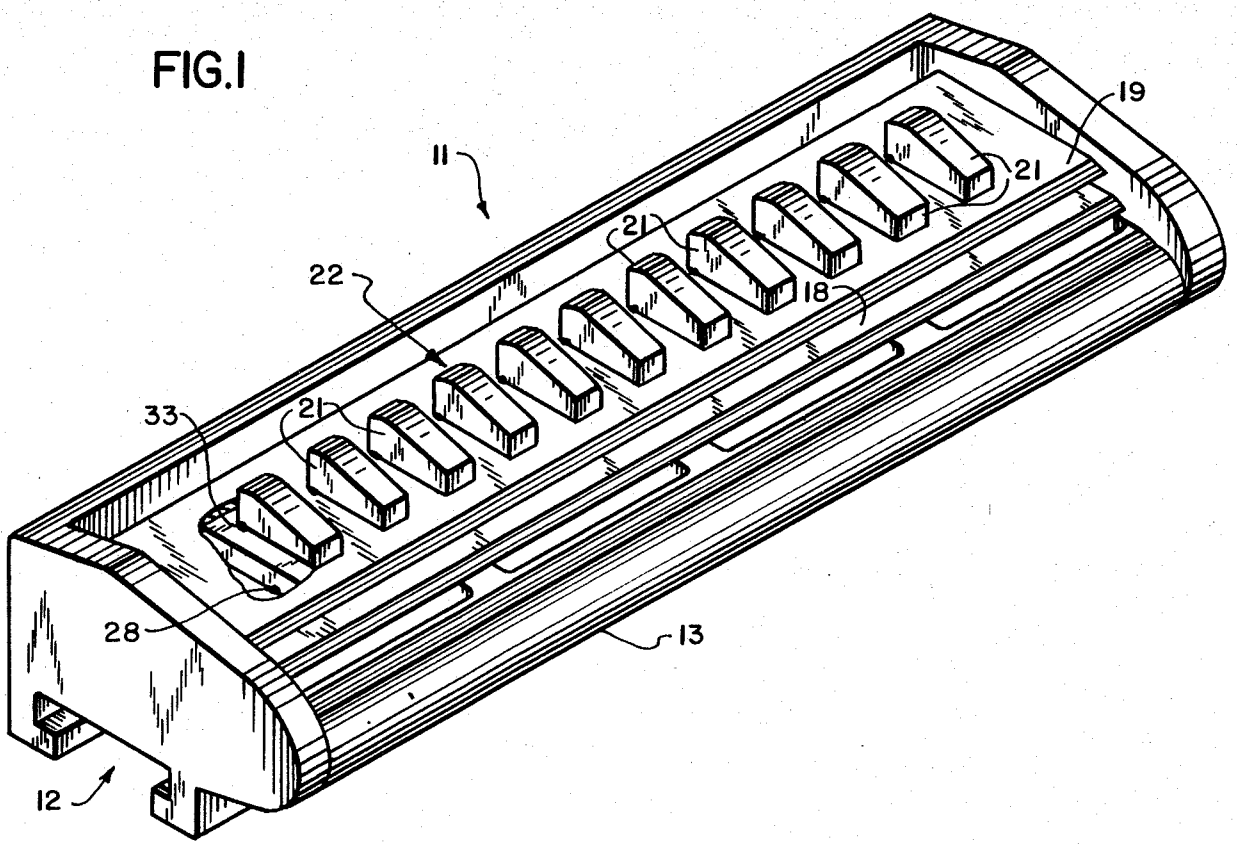
FIG. 1 is a perspective view of a razor embracing the invention.

The reference numeral 11 indicates a razor having a track 12 engageable with a razor handle (not shown) in well-known fashion.

The razor includes a first face-engaging surface defining a guard bar 13 spaced from a pair of offset cutting edges 14 and 16 by elongated through slots 17—17 providing a flow path for purging shaving debris.

Blades 18 and 19 are each formed with a plurality of perforations for receiving mating upstanding posts 21—21 which collectively define a cap or second face-engaging surface indicated generally by the reference numeral 22 in FIG. 1.

A first or lower blade 18 having a plurality of perforations 24 is in contact with and supported by a generally flat surface 26.

Offset or shoulder 27 of each post 21 projects upwardly through mating perforation 24 of lower blade 18 and makes a snug fit therewith.

Figure 2:
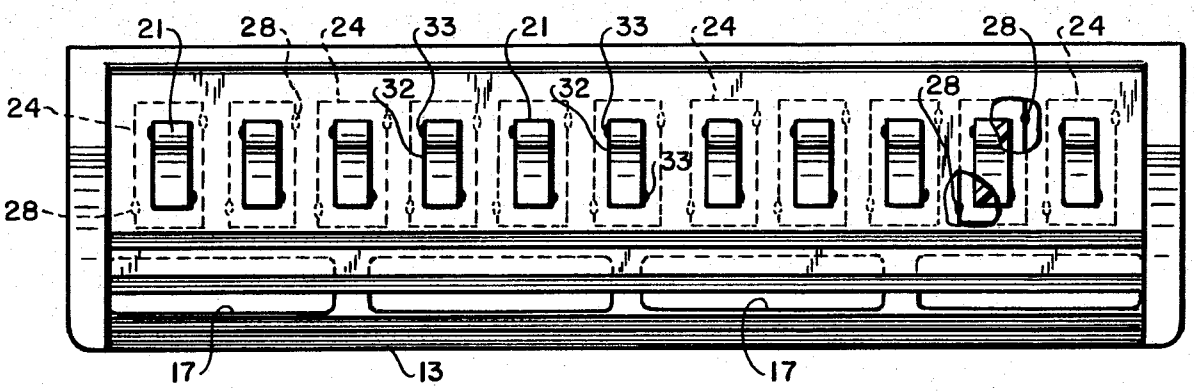
FIG. 2 is a top plan view of the razor.
Figure 3:
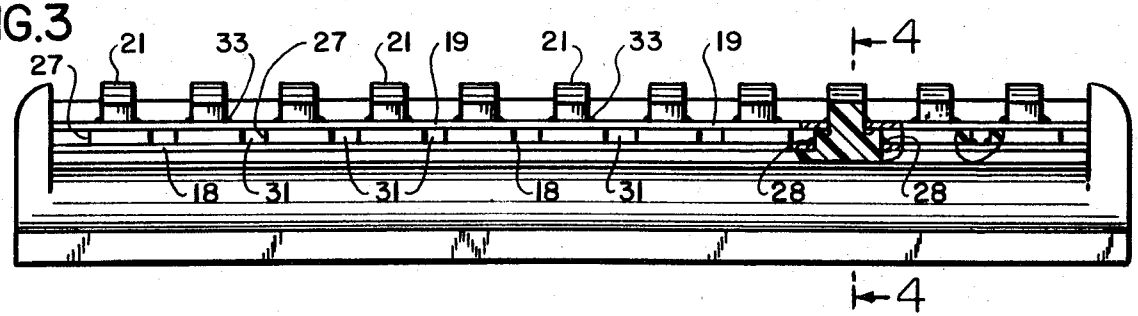
FIG. 3 is a front elevation.

Portions of the shoulder 27 are deformed or upset as shown at 28 in FIGS. 2 and 3 to fix and retain lower blade 18 in place.

Blade 19 rests on the top surface 29 of shoulder 27 providing uniform spacing between blades while creating openings 31—31 from post to post and blade to blade. The openings 31—31 collectively define an additional flow path for purging shaving debris.

Posts 21—21 project upwardly through mating perforations 23 beyond top blade 19 and are contoured as shown in FIGS. 1 and 4 to provide a second face-engaging surface with gaps 32—32 providing collectively a still further flow path for purging shaving debris.

Blade 19 is held in position by upsetting or deforming a further portion of the posts 21 as is again apparent in FIGS. 2 and 3, indicated by the reference numeral 33.

The razor is fabricated entirely of plastic with the exception of the metallic blades 18 and 19. The razor may have an integrally molded handle as shown in FIG. 5.

Furthermore, while in the disclosed embodiment the blades are anchored by upsetting a portion of the plastic posts, it is entirely within the spirit and scope of the invention to secure blades by other well-known means such as by adhesive, high-frequency welding and the like.

What is claimed is:

1. A one-piece plastic razor cartridge comprising a blade support including a face-engaging guard bar, a plurality of spaced posts projecting from said support, a perforated blade having a cutting edge disposed upon said support so that said posts project through mating perforations and said cutting edge projects toward said guard bar, each post terminating in a predetermined configuration so as to develop collectively a contoured face-engaging surface which in combination with said guard bar and blade develop optimum blade edge geometry and means for securing the blade to the blade support.

2. The razor of claim 1 in which selected posts are formed with spaced, aligned offsets or shoulders creating a second blade support for a second perforated blade, said posts project through mating perforations in said second blade and means for securing said second blade to said second blade support.

3. The razor of claim 1 or 2 including a handle formed integrally with the cartridge to define with said supports a one-piece unitary assembly.

4. The razor of claim 2 in which there are three paths for purging the razor of shaving debris, a first path defined by vertical spacing between blades, a second path defined by gaps between face-engaging portions of the posts, and a third path defined by elongated slots between the guard bar and the blade edges.

5. The razor of claim 1 or 2 in which the means for securing blades to their respective blade supports is a portion of selected posts obtained by upsetting or deforming the posts.

* * * * *